United States Patent [19]

Robinson

[11] 4,157,956

[45] Jun. 12, 1979

[54] SCREENING BUCKET

[76] Inventor: Leo E. Robinson, 4136 Brentwood, Fresno, Calif. 93703

[21] Appl. No.: 897,589

[22] Filed: Apr. 19, 1978

[51] Int. Cl.[2] ..... E02F 7/00; B07B 1/28

[52] U.S. Cl. ..... 209/260; 209/421; 414/722

[58] Field of Search ..... 209/418–421, 209/235–236, 274, 281, 260, 251, 403; 171/132; 137/544, 547; 214/145 R, 767, 146 RE

[56] References Cited

U.S. PATENT DOCUMENTS

| | | | |
|---|---|---|---|
| 1,138,679 | 5/1915 | Martin | 209/419 |
| 1,252,390 | 1/1918 | Bremer | 209/236 |
| 1,675,092 | 6/1928 | Cipriano | 209/419 |
| 3,003,265 | 10/1961 | Lutjens | 209/394 |
| 3,072,257 | 1/1963 | Hockenberry | 209/421 |
| 3,461,968 | 8/1969 | Longley | 209/241 |
| 3,732,980 | 5/1973 | Evers et al. | 209/421 |
| 3,765,490 | 10/1973 | Logue | 171/132 |

*Primary Examiner*—Robert Halper
*Assistant Examiner*—Jon E. Hokanson
*Attorney, Agent, or Firm*—Huebner & Worrel

[57] ABSTRACT

A screening bucket characterized by a rear portion, and a front portion supported for pivotal displacement toward and away from the rear portion, a pair of hydraulic slave cylinders connected to the front portion for displacing it relative to the rear portion for establishing therebetween a closeable discharge opening, a deployable flexible screen for forming a perforated occlusion for the discharge opening comprising a web formed of a plurality of links defining a myriad of discharge openings through which contents of less than a selected screen size is discharged from the bucket, and a power driven reel for alternately taking-up and paying-out the web as the front portion of the bucket is displaced relative to the rear portion thereof.

7 Claims, 10 Drawing Figures

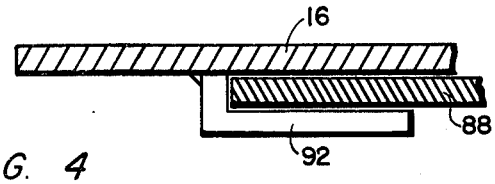
FIG. 4
FIG. 5
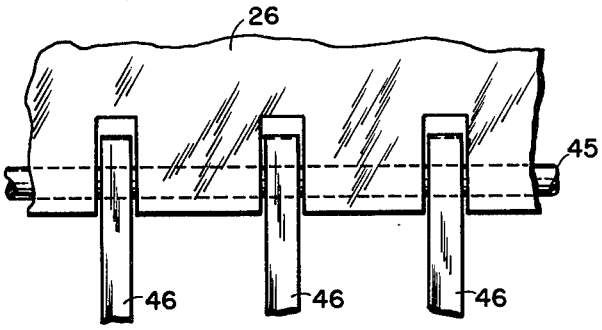
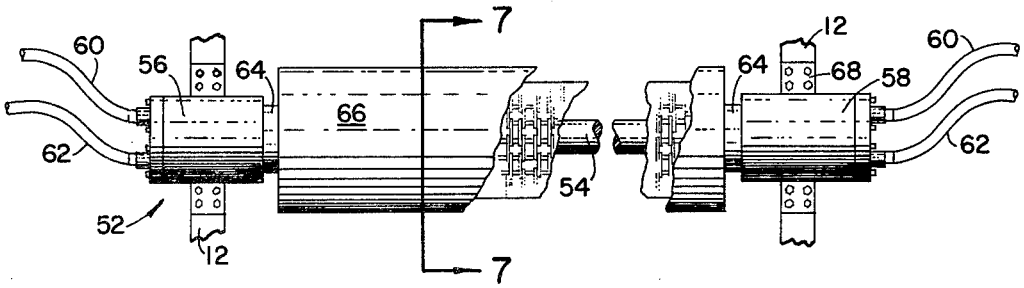
FIG. 6

SCREENING BUCKET

BACKGROUND OF THE INVENTION

1. Field of the Invention

The invention generally relates to buckets for use in the transportation and separation of particalized materials such as sand, gravel, rocks and the like for ultimate discharge into the beds of trucks, trailers and vehicles of a type frequently employed in the hauling of materials of a flowable or fluid and semi-fluid nature.

2. Description of the Prior Art

The prior art, of course, discloses a use of screens in combination with earth moving buckets. For example, see U.S. Pat. Nos. 3,003,265; 3,072,257; 3,765,490; and 3,732,980. However, it should be noted that the patents fail to disclose the use of a flexible screen attached to the rear of a bucket and supported to be deployed across a discharge opening established as the front portion of the bucket is pivotally moved away from the rear portion thereof. Attention is particularly invited to the teachings of the patent to Evers et al U.S. Pat. No. 3,732,980 which discloses a screening bucket having an aft or shell portion, a forward or clamp portion, and a large mesh screen through which material disposed in the bucket must pass before it can be discharged therefrom. The screen is of a width such that its forward sidewalls rest against the bottom plate of the forward portion of the bucket when the bucket is open to form a material discharge gap located between the two bucket portions. Upon closing of the bucket the forward end of the screen slides along the bottom plate as the bucket is closed. While such a combination may serve satisfactorily for certain purposes, it is noted that the patented bucket lacks a degree of simplicity and practicality normally desired by operators and maintenance personnel associated with the operation and maintenance of earth moving equipment and the like.

It is, therefore, the general purpose of the instant invention to provide an improved screening bucket for a front loader which is simple, practical, and economic to manufacture, employ and maintain.

OBJECTS AND SUMMARY OF THE INVENTION

It is an object of the invention to provide an improved screening bucket for use in the handling and screening of fluid loads.

Another object is to provide a screening bucket particularly suited for use in combination with a front end loader having a capability of readily performing screening operations while being of a simple, practical and economic design through which, in practice, is realized economic advantages over the prior art devices.

Another object is to provide a screening bucket which is particularly useful in combination with front end loaders, although not necessarily restricted in use thereto, since the bucket may be successfully employed when installed and operated in combination with equipment having utility in other than front loading operations.

These together with other objects and advantages are achieved through the use of a bucket having front and rear portions adapted to separate for forming therebetween a discharge opening and a flexible screen connected to one portion of the bucket and supported by a powered reel to be deployed and subsequently stowed by driving the reel as the bucket portions are separated to establish a discharge opening and subsequently brought into close proximity, for closing the discharge opening, as will become more readily apparent by reference to the following description and claims in light of the accompanying drawings.

DESCRIPTION OF THE DRAWINGS

FIG. 4 is a fragmented section view taken generally along line 4—4 of FIG. 2.

FIG. 5 is a fragmented view taken generally along line 5—5 of FIG. 3.

FIG. 6 is a fragmented elevational view illustrating a take-up reel for the screen.

DESCRIPTION OF THE PREFERRED EMBODIMENT

Figure 1:
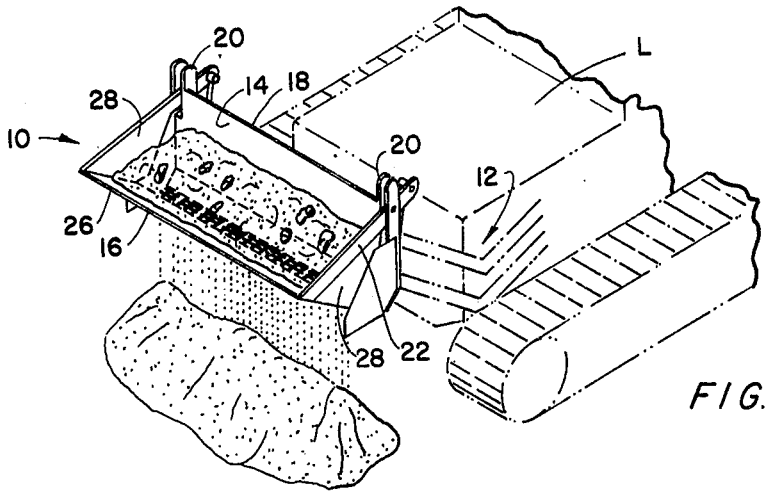
FIG. 1 is a fragmented pictorial view depicting a screening bucket which embodies the principles of the instant invention.

Referring now to the drawings with more particularity, wherein like reference characters designate like or corresponding parts throughout the several views, there is shown in FIG. 1 a front end loader, generally designated L, having mounted thereon a screening bucket, generally designated 10, which embodies the principles of the instant invention.

As shown in FIG. 1, the bucket 10 is supported by a plurality of bucket control arms 12 which serve to interconnect the bucket 10 with the loader L. The bucket is interconnected with the loader L in a manner such that its utility as a front is not impaired. Consequently, it is to be understood that the bucket is supported to be lifted, lowered, and otherwise manipulated in a manner well understood by those familiar with the operation of front loaders. Since the arms 12 form no specific part of the instant invention, a detailed description thereof is omitted in the interest of brevity, however, it is to be understood that the arms are included in a parallel linkage and preferably are manipulated by a pair of hydraulic slave cylinders, not shown.

The bucket 10, as shown in the drawings, includes a rear portion 14 and a forward or front bucket portion 16.

The rear portion 14 of the bucket includes a panel 18 extended between and connected to a pair of upright members 20, each being configured to include an upwardly opening clevis, not designated. To the clevis of each upright member 20 there is pivotally connected a bucket actuator arm, designated 22. The purpose of the arms 22 is to support the front portion 16 of the bucket 10 for pivotal displacement about a pair of pivot pins 24 extended through aligned apertures formed in each of the arms and of course, each of the opposite sides of each clevis.

The front portion 16 of the bucket 10, as shown in FIG. 1, includes a planar panel 26 extended between a pair of orthogonally related end plates 28 and is connected thereto in integral relation therewith, as by welding or the like. The end plates 28, in turn, are suspended from the arms 22. Thus the front portion of the bucket 10 is supported for pivotal displacement relative to the rear portion 14 thereof.

In order to impart pivotal displacement to the forward portion 16 of the bucket 10 there is connected to the extended end portions of the arms 22 a pair of linear actuators comprising slave cylinders 30. The cylinders preferably are connected within a hydraulic circuit such as the circuit schematically illustrated in FIG. 10.

It is important to appreciate that the circuit illustrated in the drawings comprises a plurality of suitable circuits. As shown, however, the heel portions of the slave cylinders 30 are connected to the bucket 10 through brackets 32, while the distal ends of the output shafts, designated 34, are connected through a clevis 36 integrally related to the distal ends of the arms 22. Therefore, pivotal displacement of the forward portion 16 of the bucket 10, about an axes defined by the pivot pins 24, in operation, is achieved simply by controlling the circuit for selectively pressurizing the slave cylinders 30.

Figure 3:
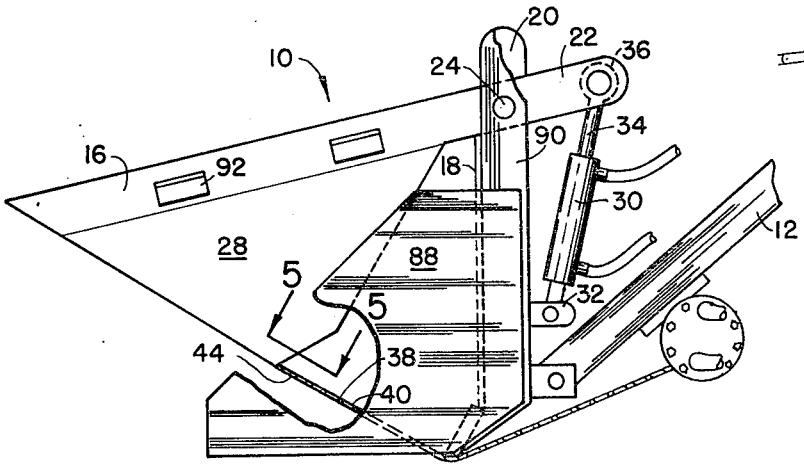
FIG. 3 is a side elevational view, similar to FIG. 2, but illustrating the bucket in its open configuration with the screen being fully deployed.
Figure 8:
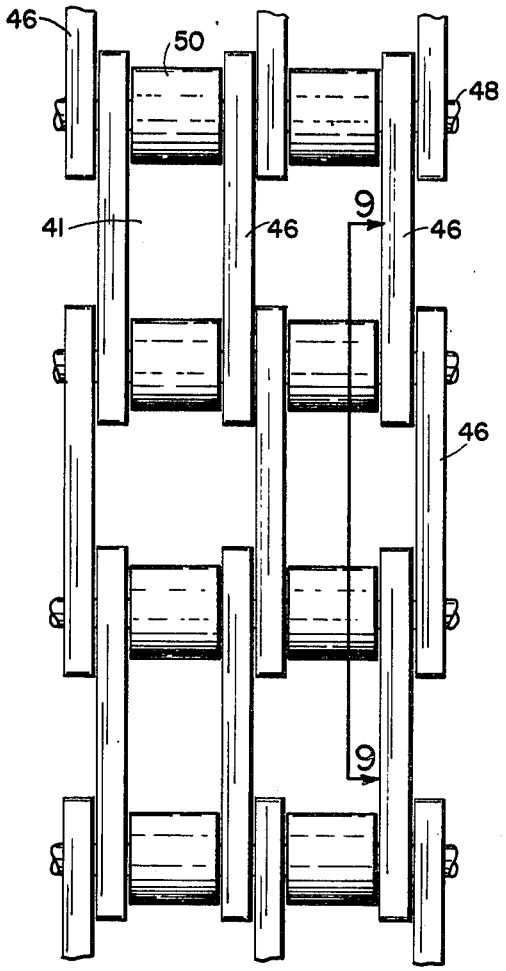
FIG. 8 is a fragmented view illustrating the screen on a substantially enlarged scale.
Figure 9:
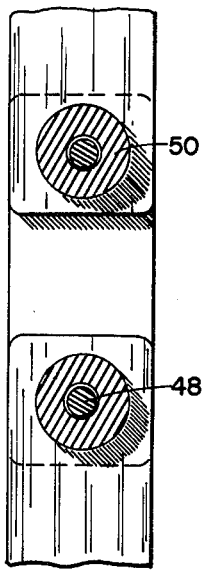
FIG. 9 is a cross-sectional view, taken generally along line 9—9 of FIG. 8.

As shown in FIGS. 1 and 3, pivotal displacement of the forward portion 16, away from the rear portion 14 of the bucket 10, serves to establish between the bucket portions a discharge opening, designated 38, FIG. 3. However, supported for occlusive deployment across the discharge opening 38 is a screen 40 having defined therein a myriad of apertures 41, FIG. 8 through which flowable contents of the bucket 10 gravitate, as pictorially illustrated in FIG. 1. The screen 40, as a practical matter, comprises a flexible web having its leading end, designated 44, connected to the trailing edge of the panel 26 through a use of a suitable connector pin 45. In practice, as best shown in FIGS. 8 and 9, the screen includes a plurality of links 46 connected simultaneously in end-to-end engagement and parallel relation by a plurality of connectors forming pivot pins designated 48. Preferably, a plurality of spacers 50 comprising rollers are mounted on the pins 48 and serve to maintain the links 46 in laterally spaced relation so that the screen size established for apertures 41 remains substantially constant. Additionally, through a use of rollers as spacers, passage of particles through the apertures 41 is enhanced as a consequence of rolling motion imparted to the spacers as material gravitates therethrough.

Figure 2:
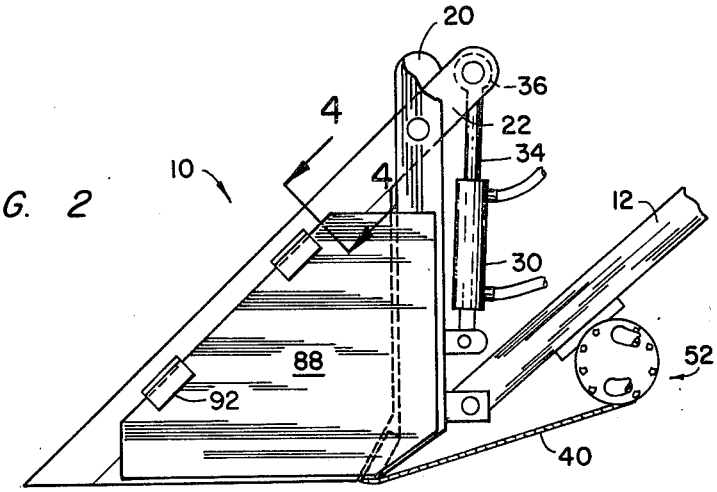
FIG. 2 is a side elevational view depicting the bucket in its closed configuration and having its screen stowed on a reel.
Figure 7:
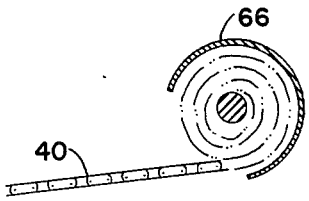
FIG. 7 is a cross sectional view taken generally along line 7—7 of FIG. 6.

The web is connected to a take-up reel assembly, generally designated 52, FIGS. 2 and 6. The take-up reel assembly 52 includes a shaft 54 supported for rotation by a plurality of bearings, not shown, and connected at its opposite ends in driving relation with a pair of hydraulic motors 56 and 58, of a suitable design. The particular design of the motors is varied as desired. Therefore, a detailed description of the motors 56 and 58 is omitted in the interest of brevity. However, it is to be understood that these motors are of a substantially common design and paired to drive in common directions, in response to a flow of hydraulic fluid passed therethrough from a pressure line to a return line. As shown in the drawings, lines 60 and 62 serve to connect the motors 56 and 58 within the hydraulic circuit and alternately are employed as pressure and return lines, depending upon the direction in which the motors 56 and 58 are to be driven for the purpose of paying-out or taking-up the screen 40 as deployment and stowage thereof is effected in a selective manner.

While a friction clutch mounted in a housing, designated 64, is employed as a protective measure for assuring undesired restraint of the screen, a direct coupling is used as desired. Since the friction clutch forms no specific part of the instant invention and its construction may be varied as desired, the detailed description of the fraction clutch is omitted in the interest of brevity.

It is noted that the screen 40 is housed in an enclosure 66 of a partial cylindrical configuration. Thus dirt and debris are readily discharged from the screen as it is deformed and withdrawn into the housing. However, the configuration and size of the housing 66 is deemed to be a matter of convenience and is varied as desired. Moreover, where desired, the housing 66 may be removed or may comprise a perforated screen for facilitating a discharge of debris as the screen is wound about the shaft 54 of the take-up reel assembly 52 is mounted on the bracket control arms 12 at a suitable location employing brackets 68, FIG. 6, bolted or otherwise rigidly affixed to the arms.

Figure 10:
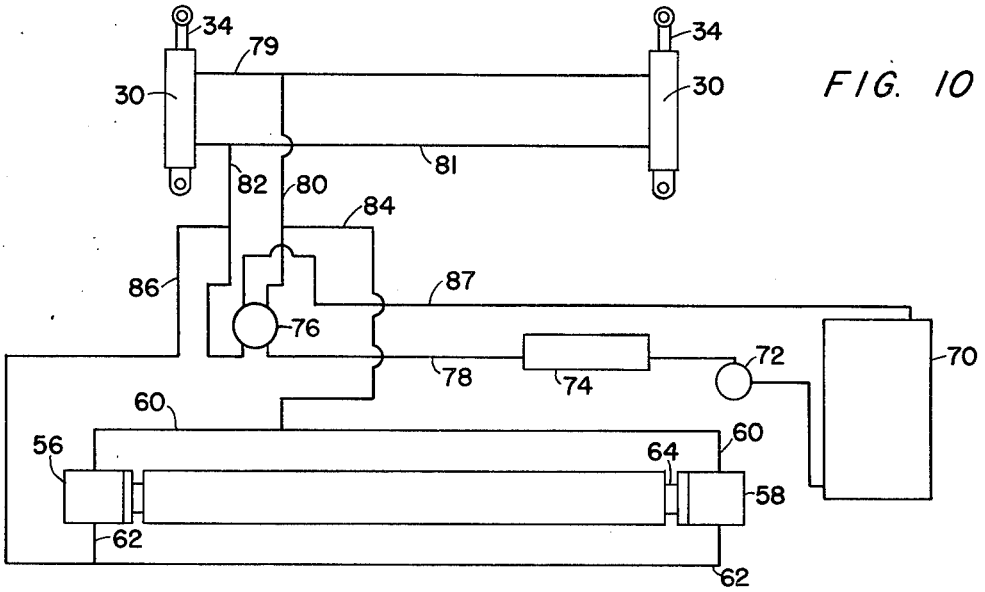
FIG. 10 is a schematic view of a hydraulic circuit for use in simultaneously controling the operation of the bucket and the screen.

Referring now to FIG. 10, it can be seen that the hydraulic circuit, as shown, includes a reservoir 70, a pump 72 and an accumulator 74 and a selector valve 76. The reservoir, pump, accumulator and selector are interconnected through a plurality of pressure lines 78 in a well known manner. The slave cylinders 30 are interconnected, at one end thereof, by a common line 79 which is connected to the selector valve 76, via a line 80 interposed between the line 79 and the selector valve. Similarly, the opposite ends of the valve cylinders 30 are interconnected by a common line 81, also connected to the selector valve 76, via a line 82. The purpose of the lines 79, 80, 81 and 82 are to establish simultaneous flows of hydraulic fluid through opposite sides of a selector valve 76, from the opposite ends of the slave cylinders 30 for thus effecting similar and simultaneous pressurization of the slave cylinders.

The selector valves 76 also are connected at opposite sides of the motors 56 and 58 to the lines 60 and 62 via branch lines 84 and 86 connected to the lines 80 and 82, respectively. Consequently, the direction in which the motors 56 and 58 are driven is determined by the position of selector valves 76. Thus it becomes possible to achieve a simultaneous operation of the motors 56 and 58 concurrently with a selected pressurization of the slave cylinders 30.

It is at this juncture noted that the fittings employed in the circuits shown in FIG. 10 are varied as desired, and that flow restrictors, not designated, are included in the circuit for purposes of assuring a simultaneous operation of the motors and cylinders in a manner well understood by those familiar with the design and operation of hydraulic systems. Since the specific circuit components employed form no part of the instant invention, a detailed discussion thereof is omitted in the interest of brevity.

Finally, it can be appreciated that it often is desirable to provide side plates 88 the purpose of which is to prevent an undesirable discharge of the contents of the bucket laterally from between the forward and rear portions of the bucket. Therefore, side plates 88, in practice, are mounted on upright members 90, preferably affixed to the upright members 20, and extend in mutual parallelism. Where desired, the upright members 90 are welded to the panel 18. It should, at this juncture, be appreciated, where desired, clips 92 are provided for imparting support to the plates 88. The clips 92 simply serve to receive the side plates 88 and support the plates when the bucket is in its loaded and closed configuration, depicted in FIG. 2.

OPERATION

It is believed that in view of the foregoing description, the operation of the bucket 10 is readily apparent. However, in the interest of assuring a complete understanding of the invention hereafter defined in the claims, the operation of the bucket will be reviewed at this point.

With the bucket 10 mounted on a front loader L, and the slave cylinders 30 and motors 56 and 58 connected within the aforedescribed hydraulic circuit, as shown in FIG. 10, the bucket 10 is prepared to be employed in a screening and/or loading operation.

The bucket is, of course, lifted and manipulated by the arms 12 in a manner well understood by those familiar with the operation of front loaders. However, once the bucket has been operated to accept a load of sand, gravel, or similar material to be screened, the bucket is lifted above the surface of the ground. The selector valve 76 which, as a practical matter, is located near the operator's compartment for the loader L, is manipulated. Such manipulation causes the selector valve to pressurize the lines 80 and 79 for causing the shaft 34 to retract, whereupon the arms 22 are caused to pivot about the pivot pins 24. As the arms are thus pivoted the front portion 16 of the bucket is pivotally displaced away from the rear portion 14 thereof. Of course, as the lines 80 are pressurized, for thus pressurizing the line 79, the motors 56 and 58 simultaneously are pressurized for driving the shaft 54 in rotation, in a direction suitable for causing the web of the screen 40 to be paid-out, as the forward portion 16 of the bucket 10 is displaced for establishing the discharge opening 38. Of course, in the event the forward portion of the bucket 10 is displaced at a rate greater than that which can be accommodated by the operation of the motors 56, the slip clutch located in the housing 64 is relied upon to accommodate an over-running of the motors.

With the forward portion of the bucket thus pivotally displaced for establishing a discharge opening 38 the fluid material, or flowable solid materials of a size accommodated by the apertures 41, gravitate downwardly through the screen, as illustrated in FIG. 1. The end plates 28, of course, prevent the materials from being discharged laterally. Of course, the arms 12 may be intermittently activated for "shaking" the bucket 10 in order to expedite the screening operation.

Once a screening operation thus has been completed the position of the selector valve 76 is reversed so that the line 80 connects the lines 79 and 84 with the return line 84, while the line 82 is placed in communication with the pressure line 78 for thus causing the lines 81 and 86 to be pressurized simultaneously. Thus the slave cylinders 30 and the motors 56 and 58 are reversely pressurized for simultaneously extending the shafts 34 and retracting the web into a wound configuration about the shaft 54. As the shafts 34 are extended, the forward portion 16 of the bucket 10 is moved into abutting engagement with the rear portion 14 for thus closing the bucket, preparatory to the occurrence of a subsequent cycle.

In view of the foregoing, it is believed to be apparent that the bucket 10 which embodies the principles of the instant invention provides a practical solution to the problem of achieving screening and loading of fluid materials such as sand, gravel and the like, employing a practical and economic device.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An improved screening bucket comprising:

a rear panel, a bottom panel disposed in displaceable engagement with the rear panel, means for displacing said bottom panel out of engagement with said rear panel for thus establishing therebetween a discharge opening for the bucket, a flexible screen having one end connected to said bottom panel supported to be transported by the bottom panel into an occlusive relationship with said discharge opening as the bottom panel is displaced, and stowage means for said flexible screen externally related to said bucket including means for paying-out said screen from stowage as the screen is transported by said bottom panel into an occlusive relationship with the opening.

2. An improved screening bucket comprising:

a rear panel, a bottom panel disposed in displaceable engagement with the rear panel, means for displacing said bottom panel out of engagement with said rear panel for establishing therebetween a discharge opening for the bucket, a flexible screen having one end connected to said bottom panel and supported to be positioned in an occlusive relationship with said opening, means comprising a reel disposed in a fixed relationship with said rear panel for storing the screen in a spirally wound configuration, and means responsive to displacement of said bottom panel relative to said rear panel for positioning said screen in an occlusive relationship with said opening.

3. The bucket of claim 2 further comprising a pair of mutually spaced arms and a pair of end panels integrally related thereto and normally related to said bottom panel for connecting said bottom panels in suspended relation with said pair of arms, and pivot means connecting said arms to said rear panel for pivotal displacement about an axis normally related to the planes of said end panels.

4. The bucket of claim 3 wherein each of said arms further includes a projection defining an actuator arm for said bucket and said means for displacing said bottom panel out of engagement with said rear panel including a pair of slave cylinders having output shafts connected to the end portions of the actuator arms for pivotally displacing said arms about said pivot means.

5. The bucket of claim 4 wherein said reel includes a rotatable shaft and means including at least one hydraulic motor connected to said shaft for selectively imparting rotary motion thereto.

6. The blanket of claim 5 wherein said screen comprises a plurality of rigid links, a plurality of transverse pins arranged in parallelism pivotally connecting the links in end-to-end engagement and in spaced parallelism, and means including a plurality of rollers mounted on the pins in spacing relation with the links.

7. A screening bucket particularly suited for use as a bucket for a front loader, comprising:

a rear portion including a first planar panel and a first pair of upright members between which the panel is extended;

a pair of bucket actuator arms pivotally connected to said pair of upright members;

a front portion comprising a second planar panel having a pair of integrally related end walls suspended from said pair of actuator arms and supported thereby for pivotal displacement relative to said rear portion;

means including a pair of hydraulic slave cylinders connected to said pair of actuator arms for pivotally displacing said front portion away from said rear portion for thereby establishing a bottom discharge opening for said bucket;

a flexible screen deployable for forming a perforated occlusion for the discharge opening including a web comprising a plurality of rigid links, and means including a plurality of pins and spacer rollers interconnecting the link in simultaneous end-to-end and parallel relation;

means supporting the screen for deployment including a motor-driven take-up spindle mounted in juxtaposition with said rear portion of the bucket for receiving the web in a wound relationship therewith; and means for deploying the screen including a coupling pin coupling one end of the screen to the front portion of the bucket, and means for accommodating an unwinding of the web from the spindle as the front portion is displaced away from the rear portion of the bucket.

* * * * *

UNITED STATES PATENT AND TRADEMARK OFFICE

CERTIFICATE OF CORRECTION

PATENT NO. : 4,157,956

DATED : June 12, 1979

INVENTOR(S) : Leo E. Robinson

It is certified that error appears in the above-identified patent and that said Letters Patent are hereby corrected as shown below:

Column 5, line 58, delete "84" and substitute ---87---,

Column 6, line 65, delete "blanket" and substitute ---bucket---.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*